US010426207B2

(12) United States Patent
Dorros

(10) Patent No.: US 10,426,207 B2
(45) Date of Patent: Oct. 1, 2019

(54) CLIP APPARATUSES AND METHODS OF MAKING AND USING THE SAME

(71) Applicant: Elizabeth Dorros, Chicago, IL (US)

(72) Inventor: Elizabeth Dorros, Chicago, IL (US)

( * ) Notice: Subject to any disclaimer, the term of this patent is extended or adjusted under 35 U.S.C. 154(b) by 338 days.

(21) Appl. No.: 15/075,284

(22) Filed: Mar. 21, 2016

(65) Prior Publication Data

US 2016/0270455 A1 Sep. 22, 2016

Related U.S. Application Data

(60) Provisional application No. 62/135,600, filed on Mar. 19, 2015.

(51) Int. Cl.

| | |
|---|---|
| ***A41F 1/00*** | (2006.01) |
| ***A41F 19/00*** | (2006.01) |
| ***A41D 1/215*** | (2018.01) |
| *A44B 99/00* | (2010.01) |

(52) U.S. Cl.

CPC ..... *A41F 19/00* (2013.01); *A41D 1/215* (2018.01); *A41F 1/006* (2013.01); *A44B 99/00* (2013.01)

(58) Field of Classification Search

CPC ..... A41D 1/205; A41D 1/215; A41F 1/006; A41F 19/00; A44B 99/00

See application file for complete search history.

(56) References Cited

U.S. PATENT DOCUMENTS

| | | | | |
|---|---|---|---|---|
| 282,945 | A | 8/1883 | Bacon | |
| 749,145 | A | 1/1904 | Andresen | |
| 1,345,191 | A | 6/1920 | Hutchison | |
| 1,462,193 | A | 7/1923 | Cook | |
| 1,675,806 | A | 7/1928 | Holden | |
| 1,814,436 | A | 7/1931 | Saussure, Jr. | |
| 1,878,861 | A | 9/1932 | Krasnow | |
| 1,888,704 | A | 11/1932 | Swett | |
| 2,539,367 | A * | 1/1951 | Greenberg | A41F 1/00 24/557 |
| 2,559,293 | A * | 7/1951 | Gadomski | A41F 1/00 24/343 |
| 3,922,763 | A * | 12/1975 | Buerger | A44B 99/00 24/559 |
| 4,055,874 | A * | 11/1977 | Brown | B42F 1/10 24/560 |
| 4,096,655 | A | 6/1978 | Ullman, Jr. | |
| 4,423,734 | A | 1/1984 | Schawel | |
| 4,536,924 | A * | 8/1985 | Willoughby | A44B 99/00 24/487 |
| 4,928,361 | A | 5/1990 | Brown | |
| 5,117,537 | A | 6/1992 | Hunter et al. | |
| 5,775,345 | A * | 7/1998 | Chou | A45D 8/14 132/278 |
| 6,427,244 | B1 * | 8/2002 | Speier | A41D 1/215 2/104 |
| 8,061,068 | B1 | 11/2011 | Donovan | |

(Continued)

*Primary Examiner* — Robert Sandy

*Assistant Examiner* — Louis A Mercado

(74) *Attorney, Agent, or Firm* — Scherrer Patent & Trademark Law, P.C.; Stephen T. Scherrer; Monique A. Morneault

(57) ABSTRACT

Clip apparatuses for use in breast feeding allow a user to secure the same on an article of clothing or fabric so that the user can track breastfeeding of an infant. Methods of making and using the same are further provided.

19 Claims, 5 Drawing Sheets

(56) References Cited

U.S. PATENT DOCUMENTS

| | | | | |
|---|---|---|---|---|
| 8,640,266 | B2 * | 2/2014 | Best | A44C 15/003 2/104 |
| 9,565,879 | B2 * | 2/2017 | LaHann | A41D 1/205 |
| D794,870 | S * | 8/2017 | Hsu | D28/40 |
| 2004/0156268 | A1 | 8/2004 | Hall | |
| 2007/0119810 | A1 | 5/2007 | Boles | |
| 2010/0154104 | A1 * | 6/2010 | Winning | A41D 1/215 2/323 |
| 2010/0186149 | A1 | 7/2010 | Miller | |
| 2010/0287987 | A1 | 11/2010 | Zeidel et al. | |
| 2012/0151657 | A1 | 6/2012 | Gibbons et al. | |
| 2014/0000009 | A1 | 1/2014 | Marvald | |
| 2017/0027242 | A1 * | 2/2017 | Asodaria | A41D 1/215 |
| 2017/0119067 | A1 * | 5/2017 | LaHann | A41D 1/205 |

* cited by examiner

CLIP APPARATUSES AND METHODS OF MAKING AND USING THE SAME

The present invention claims priority to U.S. Provisional Patent Application No. 62/135,600, titled "Clip Apparatuses and Methods of Making and Using the Same", filed Mar. 19, 2015, which is incorporated herein by reference in its entirety.

TECHNICAL FIELD

The present invention relates to clip apparatuses. Specifically, the clip apparatuses can be used for various purposes to attach to fabric, straps, wires, and other like clothing articles. More specifically, the clip apparatuses may be used for a method for breastfeeding. Specifically, the clip apparatus allows a user to secure the same on an article of clothing or fabric so that the user can track breastfeeding of an infant. Methods of making and using the same are further provided.

BACKGROUND

It is often difficult for a new mother to track breastfeeding. Oftentimes, a new mother is overwhelmed with having a new baby, and is frequently tired because a new baby typically allows little sleep and requires constant attention. Indeed, it is often the case that new babies require feedings every few hours, if not more frequently.

It is advantageous for a mother to switch breasts from one feeding to another, which may maximize the mother's hind milk, which is often mother's milk that is higher in fat content and typically let down at the end of a feeding. Thus, switching breasts between feedings often provides better nourishment to babies, and is often desirable.

It is difficult, however, for a new mother to easily track which side the baby last fed, no doubt due to many factors including the frequency of feedings (which may include from between 12-20 feedings per day on average, referred to as "cluster feedings" in the initial weeks of breastfeeding), as well as due to feelings of exhaustion and being overwhelmed. All of these factors may make it difficult for a new mother to determine with which side she last fed her baby and, consequently, which side to use presently. Therefore, a need exists for an aid to help new mothers track feedings. Moreover, as mothers become more skilled in understanding their body cues after months of practice, breastfeeding can still be a monotonous task. Thus, the need to keep track of feedings may continue in more experienced mothers.

A need, therefore, exists for a breastfeeding tracking apparatus. More specifically, a need exists for a breastfeeding tracking apparatus that allows a mother to track on which side her baby last fed.

Moreover, a need exists for a clip apparatus for tracking breastfeeding. Specifically, a need exists for a clip apparatus that may be easily utilized by a mother to move from one side of her bra, strap or breast to the other to use as a tracking apparatus or as a reminder. More specifically, a need exists for a clip apparatus that may be clipped onto an article of clothing, such as a nursing bra or other like clothing.

In addition, a need exists for a clip apparatus that may be relatively small in size so as not to be intrusive, but large enough so that the clip apparatus does not become a choking hazard for an infant. In addition, a need exists for a clip apparatus that is resilient to withstand washing or frequent use. More specifically, a need exists for a clip apparatus for tracking breastfeeding that may have a size, shape and made from material that may be easy to hold, comfortable to wear, and allow a user to engage and disengage the same easily, such as with one hand.

SUMMARY OF THE INVENTION

The present invention relates to clip apparatuses for use in breast feeding. Specifically, the clip apparatus allows a user to secure the same on an article of clothing or fabric so that the user can track breastfeeding of an infant. Methods of making and using the same are further provided.

To this end, in an embodiment of the present invention, a clip apparatus is provided for using with breastfeeding to remind a user of a side the baby previously fed on. A clip apparatus comprising: a bottom plate; a top plate; a bridge between the bottom plate and the top plate holding the bottom plate a distance from the top plate; and a protrusion extending upwardly from the bottom plate toward the top plate.

In an embodiment, the clip apparatus further comprises an aperture disposed in the top plate.

In an embodiment, the protrusion extends through the aperture disposed in the top plate.

In an embodiment, the bridge is disposed on a side of the clip apparatus.

In an embodiment, the protrusion is mound-shaped.

In an embodiment, the clip apparatus further comprises a resilient frame disposed within the bottom plate, the top plate and the bridge.

In an embodiment, the resilient frame is made of metal.

In an embodiment, the top plate, the bottom plate and the bridge are made from the same material.

In an embodiment, the protrusion is made from the same material as the top plate, the bottom plate and the bridge.

In an embodiment, the protrusion is made from a different material as the top plate, the bottom plate and the bridge.

In an alternate embodiment of the present invention, a system is provided. The system comprises the clip apparatus, and a clothing article disposed over the protrusion and frictionally held in place over the protrusion.

In an embodiment, the top plate comprises an aperture and the clothing article is frictionally held between the protrusion and an edge of the aperture of the top plate.

In an embodiment, the clothing article is frictionally held between the protrusion and a bottom surface of the top plate.

In a further alternate embodiment of the present invention, a method of using a clip apparatus is provided. The method comprises the steps of providing a clip apparatus comprising a bottom plate, a top plate, a bridge between the bottom plate and the top plate holding the bottom plate a distance from the top plate, and a protrusion extending upwardly from the bottom plate toward the top plate; providing an article of clothing comprising a strap; and disposing the strap of the article of clothing into the clip apparatus so that the strap is disposed over the protrusion and is resiliently within the clip apparatus at a first location on the strap.

In an embodiment, the strap of the article is resiliently held over the protrusion.

In an embodiment, the top plate comprises an aperture and the protrusion is disposed through the aperture.

In an embodiment, the strap of the article of clothing is resiliently held between the protrusion and the top plate.

In an embodiment, the method further comprises the step of: moving the clip apparatus to a second location comprising a second strap; and disposing the second strap within the clip apparatus.

In an embodiment, the clip apparatus is disposed at the first location at a first time, and the clip apparatus is disposed at the second location at a second time, wherein the second time is after breastfeeding a baby.

In an embodiment, the first location is a first side of a person and the strap is a first bra strap, and the second location is a second side of a person and the second strap is a second bra strap.

It is, therefore, an advantage and objective of the present invention to provide a breastfeeding tracking apparatus.

More specifically, it is an advantage and objective of the present invention to provide a breastfeeding tracking apparatus that allows a mother to track on which side her baby last fed.

Moreover, it is an advantage and objective of the present invention to provide a clip apparatus for tracking breastfeeding.

Specifically, it is an advantage and objective of the present invention to provide a clip apparatus that may be easily utilized by a mother to move from one side of her body to the other to use as a tracking apparatus.

More specifically, it is an advantage and objective of the present invention to provide a clip apparatus that may be clipped onto an article of clothing, such as a nursing bra or other like clothing.

In addition, it is an advantage and objective of the present invention to provide a clip apparatus that may be relatively small in size so as not to be intrusive, but resilient to withstand washing or frequent use.

More specifically, it is an advantage and objective of the present invention to provide a clip apparatus for tracking breastfeeding that may have a size, shape and made from material that may be easy to hold, and allow a user to engage and disengage the same easily, such as with one hand.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to clip apparatuses for use in breast feeding. Specifically, the clip apparatus allows a user to secure the same on an article of clothing or fabric so that the user can track breastfeeding of an infant. Methods of making and using the same are further provided.

Figure 1A:
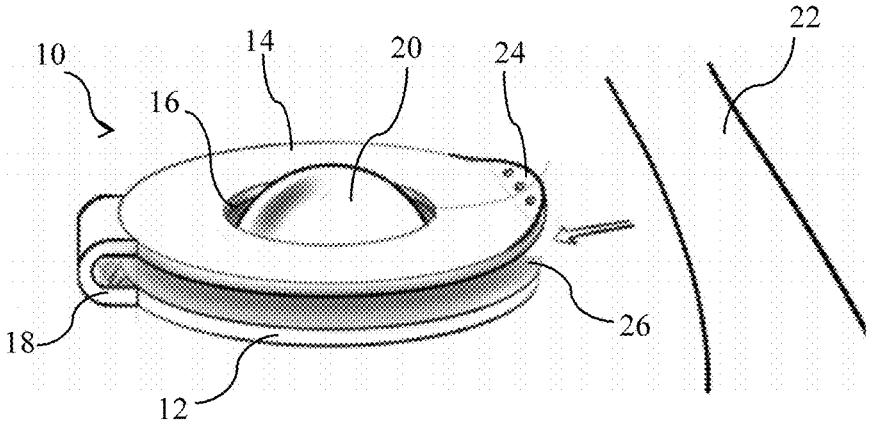
FIGS. 1A and 1B illustrate perspective views of a clip apparatus for tracking breastfeeding disengaged and engaged to a clothing article, namely a bra strap.
Figure 1B:
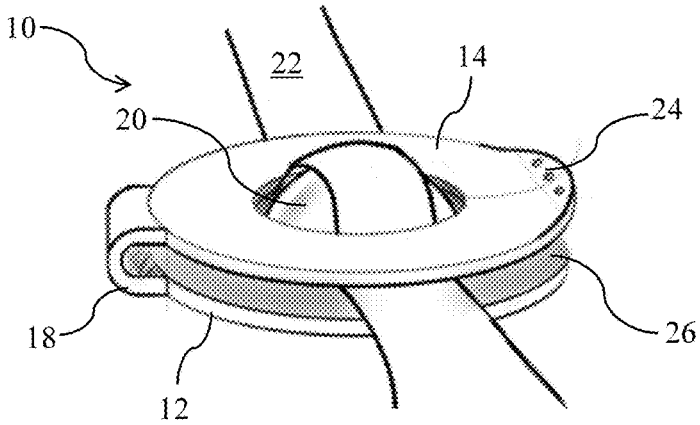

Now referring to the figures, wherein like numerals refer to like parts, FIGS. 1A and 1B illustrate a clip apparatus 10 in an embodiment of the present invention. The clip apparatus 10 comprises a bottom plate 12 and a top plate 14, the top plate 14 having an aperture 16 therein. The bottom plate 12 and the top plate 14 may be connected via a bridge 18 that may hold the bottom plate 12 and the top plate 14 a distance apart from each other. Extending from the bottom plate 12 may be a protrusion or projection 20 that may extend partially or fully through the aperture 16.

A strap 22, for example, on a women's brassiere, or other clothing article may be disposed in the clip apparatus 10, as illustrated in FIGS. 1A and 1B. Although the present disclosure refers to the strap 22, it should be noted that any article of clothing or fabric, such as another part of the women's brassiere, or other like article, may be utilized in the present invention without detracting from the spirit of the invention, and the invention should not be limited as specified herein.

Specifically, the strap 22 may be slid between the bottom plate 12 and the top plate 14 through an open end 26 of the clip apparatus 10 such that the strap may weave from one end of the clip apparatus 10 to the other end of the clip apparatus 10, and over the protrusion or projection 20. Thus, the weaving of the strap 22 may provide sufficient friction to hold the clip apparatus 10 onto the strap 22. Thus, the clip apparatus 10 may be easily clipped or otherwise removably connected or attached to the strap 22. It is preferable that the clip apparatus 10 be easy to use such that a user may removably attach the clip apparatus 10 to an article of clothing, such as strap 22, with only one hand.

The clip apparatus 10 may further optionally comprise a lip 24 allowing a user to use his or her finger to easily separate the bottom plate 12 from the top plate 14 to allow the strap 22 to be disposed therein. Thus, the bridge 18 may act as a resilient leaf spring holding the bottom plate 12 and the top plate 14 the distance from each other when the strap 22 is disposed therein. The bridge may be rigid and resilient, and provide only a slight springing deflection to allow a user to easily move the strap 22 therein. Alternately, the bridge may provide significant deflection to accommodate clothing articles of varying thicknesses. In an alternate embodiment, the bridge 18 provides no movement of the bottom plate 12 relative to the top plate 14, and the strap 22 may simply be weaved over the protrusion or projection 20, as needed.

Preferably, the clip apparatus 10, and other clip apparatuses disclosed below, may be made from any material useful for providing strength, rigidity, and resiliency, such as, for example, metal, plastic, silicone, rubber, fabric or other like materials and combinations thereof. Moreover, it is preferable that the clip apparatus 10, and the clip apparatuses disclosed below, be able to withstand wash cycles in an automatic washing machine, as it is likely that the clip apparatus will be accidentally or even purposefully washed. Moreover, it is preferred that the material be gentle and comfortable when used by a user, as the clip apparatus 10 and other clip apparatuses disclosed below may come into contact with the mother's skin when removably attached to an article of clothing.

Alternatively, the clip apparatus 10 may comprise a movable protrusion or projection 20 that may be moved to allow the strap 22 to be placed within the clip apparatus 10, whereby the protrusion or projection 20 may be moved back into its original position to engage the strap 22. For example, the protrusion or projection 20 may be spring loaded, and may be pushed through an aperture in the bottom plate 12 to be either fully or partially retracted, thereby providing more space for the strap 22 to be moved into the clip apparatus 10. Once the strap 22 is in position within the clip apparatus 10, the protrusion or projection 20 may be released to move back into its original position. The protrusion or projection may engage the top plate 14, when moved back to its original position, to frictionally hold the strap 22 within the clip apparatus 10.

Figure 2:
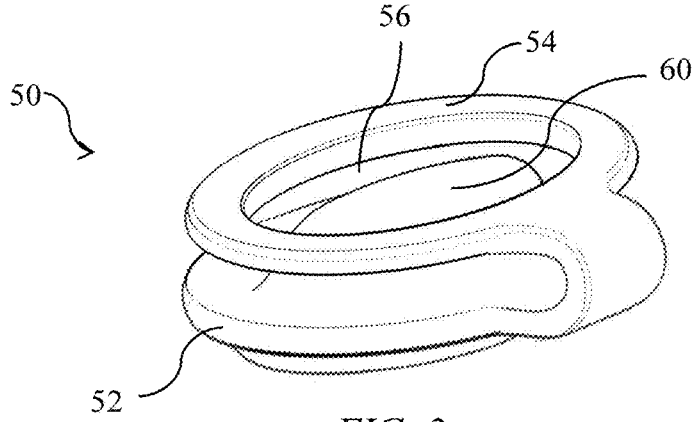
FIG. 2 illustrates a perspective view of a clip apparatus having a rounded protrusion for catching a clothing article in an embodiment of the present invention.

FIG. 2 illustrates an alternate embodiment of the present invention, of a clip apparatus 50 having similar features as the clip apparatus 10, as disclosed above. Specifically, the clip apparatus 50 may comprise a bottom plate 52, a top plate 54 having an aperture 56, and an ovoid-shaped protrusion 60 extending from the bottom plate 52 extending partially or fully through the aperture 56. A bridge 58 may resiliently hold the bottom plate 12 a distance from the top plate 14, allowing no, slight or significant deflection of the bottom plate 12 relative to the top plate 14 to allow an article of clothing to be disposed over the protrusion 60. The protrusion 60 may be rounded, similar to the projection or protrusion 20, disclosed above with reference to FIGS. 1A and 1B. The rounded protrusions 20, 60 may be preferred to allow an article of clothing to easily slide on or off, depending on whether the clip apparatuses 10, 50 are being engaged or disengaged with the article of clothing.

Figure 3:
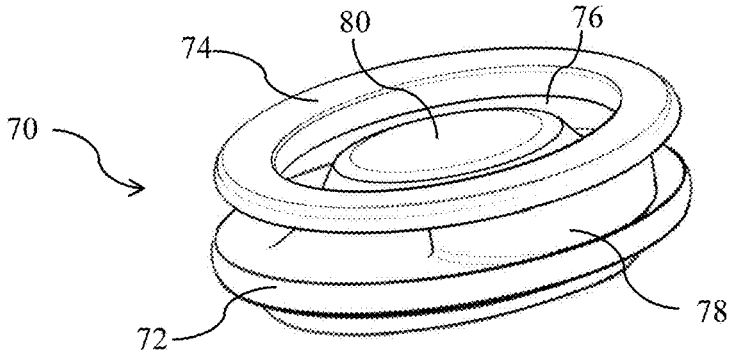
FIG. 3 illustrates a perspective view of a clip apparatus having a flattened projection for catching a clothing article in an embodiment of the present invention.

FIG. 3 illustrates an alternate embodiment of the present invention, of a clip apparatus 70 having similar features as the clip apparatuses 10, 50, disclosed above. Specifically, the clip apparatus 70 may comprise a bottom plate 72, a top plate 74 having an aperture 76 and a flat-topped protrusion 80 extending partially or fully through the aperture 76. The flat topped protrusion 80 may provide a relatively sharp angle between the sides of the protrusion 80 and the top of the protrusion 80, which may aid in frictionally holding an article of clothing thereon when disposed in a weave over the protrusion 80.

In addition, clip apparatus 70 further comprises a bridge 78 disposed between the bottom plate 72 and the top plate 74, allowing the bridge 78 to be less conspicuous and less intrusive when used by a user as compared to bridges 18, 58, disclosed above. However, the bridge 78 may function the same or similarly to the bridges 18, 58, as disclosed above.

Figure 4:
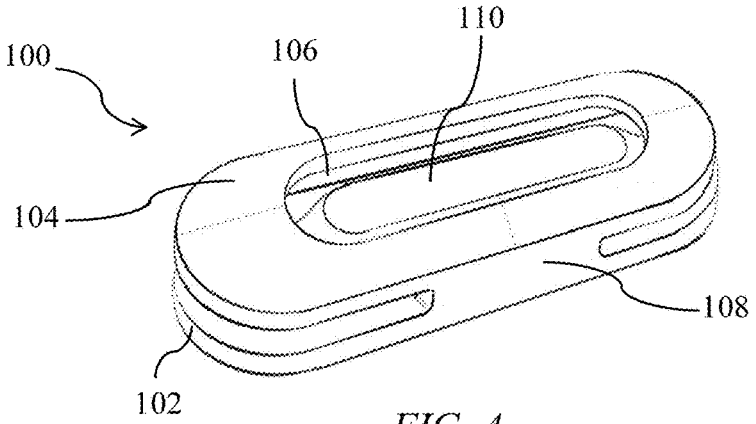
FIG. 4 illustrates a perspective view of an ovoid-shaped clip apparatus having a flattened projection for catching a clothing article in an embodiment of the present invention.

FIG. 4 illustrates an alternate embodiment of the present invention of a clip apparatus 100 having similar features as described above. The clip apparatus 100 is shown as being ovoid-shaped, but it should be noted that the various embodiments of clip apparatuses described herein may be any shape apparent to one having ordinary skill in the art. The clip apparatus 100 may comprise a bottom plate 102, a top plate 104, an aperture 106, and a flat-topped protrusion 110 extending partially or fully through the aperture 106. The bottom plate 102 and the top plate 104 may be separated from each other via bridge 108. Functionally, the clip apparatus 100 operates similarly to the clip apparatuses 10, 50 and 70, described above. An article of clothing may be disposed therein, and held in place frictionally by being weaved over the protrusion110.

Figure 5:
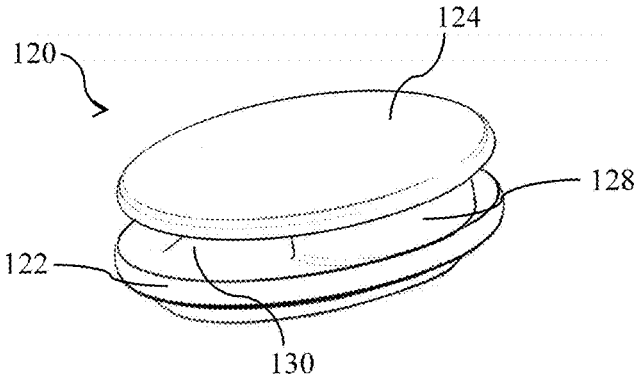
FIG. 5 illustrates a perspective view of a clip apparatus having a top plate for providing a friction fit for an article of clothing disposed therein, such as a strap, in an embodiment of the present invention.

In an alternate embodiment of the present invention, illustrated in FIG. 5, a clip apparatus 120 is illustrated. The clip apparatus 120 comprises a bottom plate 122 separated by bridge 128. A protrusion 130 extends from the bottom plate 122 toward the top plate 124. As illustrated in FIG. 5, the top plate 124 does not have an aperture as in the previous embodiments. The protrusion 130 may preferably extend upwardly toward the top plate 124, but may provide a small space between the top of the protrusion 130 and the bottom surface of the top plate, allowing an article of clothing to reside, and frictionally holding the article of clothing between the top of the protrusion 130 and the bottom surface of the top plate 124. Alternatively, the top of the protrusion may contact the bottom surface of the top plate 124, such that an article of clothing may be disposed therein via deflection caused by the bridge 128. Once the article of clothing is disposed in position over the protrusion 130, the user may cease deflecting the bottom plate 122 from the top plate 124, and the top of the protrusion 130 may push the article of clothing against the bottom surface of the top plate 124, frictionally holding the article of clothing in place.

Figure 6:
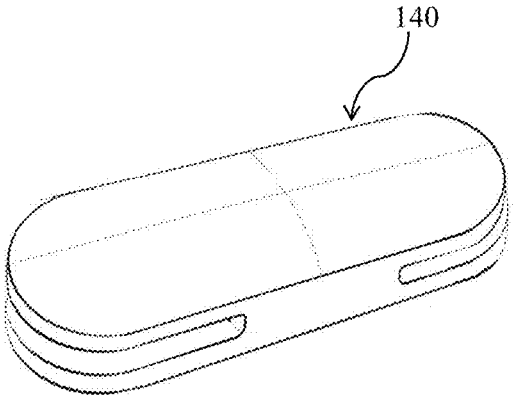
FIG. 6 illustrates a perspective view of an ovoid-shaped clip apparatus having a top plate for providing a friction fit for an article of clothing disposed therein, such as a strap, in an embodiment of the present invention.

FIG. 6 shows a similar clip apparatus 140 in an alternate embodiment of the present invention, having an ovoid shape, but otherwise functioning the same or similarly to the clip apparatus 120, disclosed above.

Figure 9:
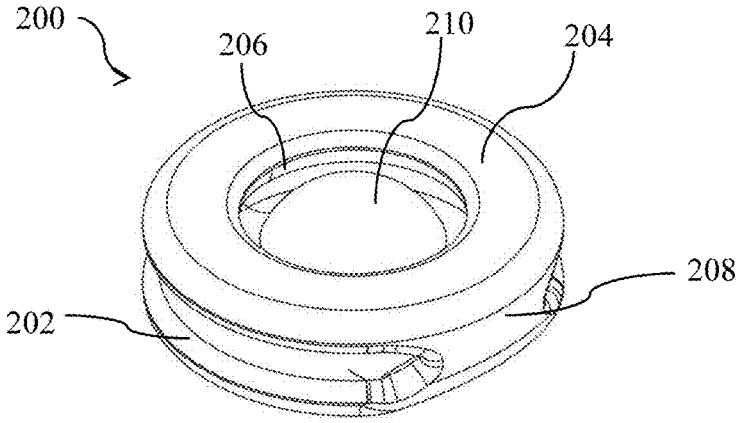
FIG. 9 illustrates a perspective view of a circular-shaped clip apparatus for providing a friction fit for an article of clothing disposed therein, such as a strap, in an embodiment of the present invention.

FIG. 9 illustrates a perspective view of a clip apparatus 200 in a preferred embodiment of the present invention. The clip apparatus 200 comprises a bottom plate 202 and a top plate 204 and a bridging member 208 disposed therebetween on a first side thereof. The bottom plate 202 may have a protrusion 210 in the shape of a mound extending from the bottom plate 202 toward the top plate and through an aperture 206 disposed within the top plate. In use, a strap of an article of clothing, such as a bra strap, may be disposed within the clip apparatus 200 by sliding the same up and over the mound 210. The mound holds the strap in place.

Figure 10:
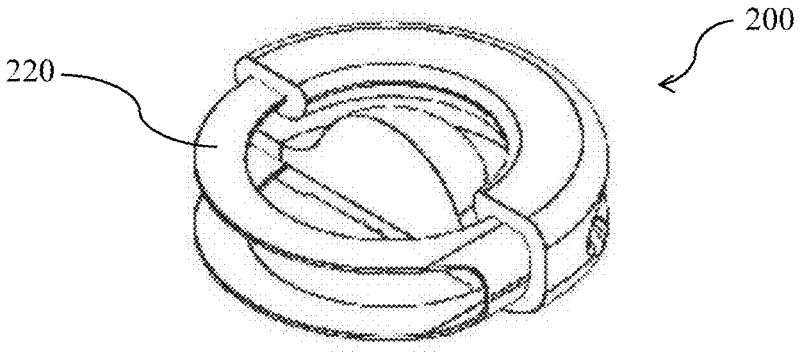
FIG. 10 illustrates a cut-away perspective view of a circular-shaped clip apparatus in an embodiment of the present invention.

The clip apparatus 200 may be made from any material apparent to one of ordinary skill in the art, including plastic, elastomeric rubber, metal and other like materials. Preferably, the top plate 204, bottom plate 202, bridging member 208 and mound 210 may be made from the same material, such as a hardened plastic or an elastomeric rubber. More preferably, the top plate 204, bottom plate 202 and bridging member 208 may be made from a first material and the mound 210 may be made from a second material having different properties. Most preferably, the top plate 204, bottom plate 202, and bridging member 208 may be made from a hardened plastic material, and the mound 210 may be made from a soft, rubbery elastomeric material to aid in holding the strap thereon. In another embodiment, shown in FIG. 10, a resilient frame 220 may be contained within the various parts to stiffen the same. Specifically, the resilient frame 220 may be made of metal, although the present invention should not be limited as described herein, as the resilient frame 220 may be any material that offers strength and resiliency to the clip apparatus 200.

Figure 11:
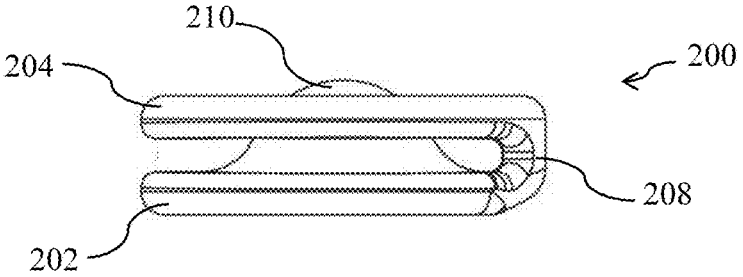
FIG. 11 illustrates a side view of a circular-shaped clip apparatus in an embodiment of the present invention.

FIG. 11 illustrates a side view of clip apparatus 200. As illustrated, mound 210 may extend from bottom plate 202 and may extend upwardly through aperture 206 so that the apex of the mound 210 rests above the top surface of the top plate 204. This may help retain the strap of the article of clothing to ensure a snug fit so that the clip apparatus does not become loose and fall off the article of clothing.

Figure 7:
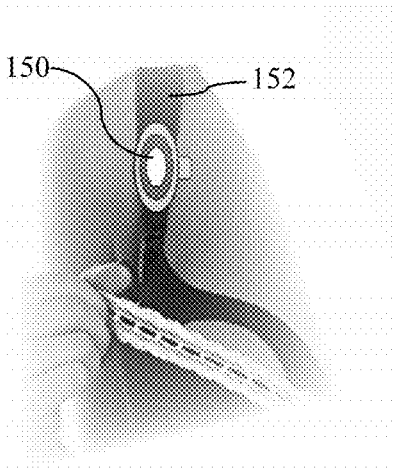
FIG. 7 illustrates a clip apparatus of the present invention removably attached to a nursing bra strap in an embodiment of the present invention.
Figure 12:
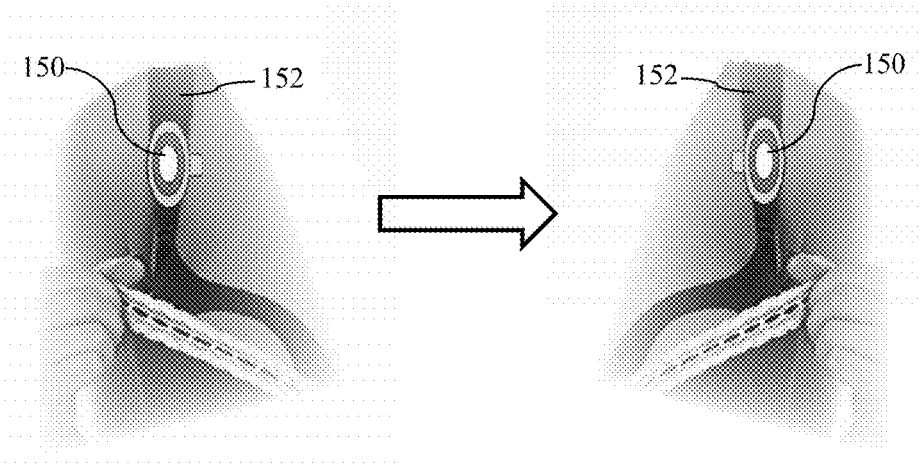
FIG. 12 illustrates a clip apparatus of the present invention on a right bra strap moved to a left bra strap in an embodiment of the present invention.

FIG. 7 illustrates use of a clip apparatus 150 as described herein. Specifically, the clip apparatus 150 may be any one of the clip apparatuses 10, 50, 70, 100, 120, 140, 170, 200 or any other clip apparatus having similar features and functions, and may be disposed on a strap 152, such as a nursing bra strap as shown in FIG. 7, or on any other article of clothing. In use, a baby may feed on one side and the clip apparatus 150 may be moved to the side that the baby has fed, as illustrated in FIG. 12. At the next feeding, the mother will now know which side the baby fed on previously, and may switch sides as desired.

The clip apparatuses disclosed herein may further comprise removably attachable cover plates or faces thereto that may be used to impart information, logos, colors, or other like indicia that may be desirable by users of the same. For example, a cover plate or face may comprise a functional mechanical or electrical counter, or other like mechanism for tracking the number of feedings as well. Alternatively, an electronic clock may be provided on a cover plate or face that may be disposed on the clip apparatuses of the present invention, as disclosed herein.

Figure 8:
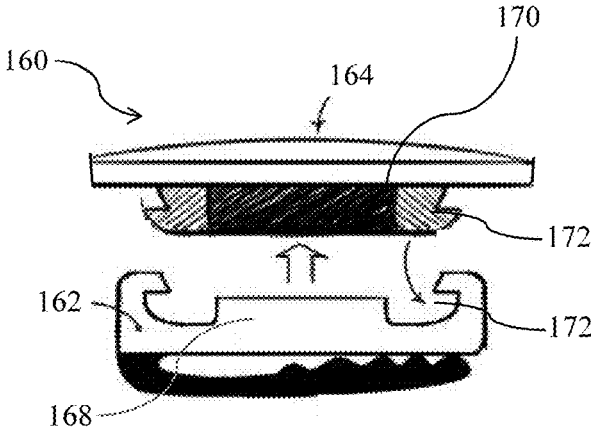
FIG. 8 illustrates a side cut-away view of a clip apparatus in an alternate embodiment of the present invention.

FIG. 8 illustrates an alternate embodiment of the present invention of a clip apparatus 160 having a bottom plate 162 and a top plate 164 that may be removably engageable with each other via one or more clips 172 that may engage mating areas 174. The bottom plate 162 may further comprise a protrusion 168 extending toward a recess 170 in the top plate 164 for engaging a strap, fabric, or other like clothing article. Specifically, a layer of fabric may be disposed between the bottom plate 162 and the top plate 164, whereupon the bottom plate 162 and top plate 164 are mated together via the one or more clips 172 and the mating areas 174. The protrusion may push the strap or fabric upwardly into the recess 170, thereby providing the weave that may hold the clip apparatus 160 in place on the strap, fabric or other like clothing article. A stem pin 176 may extend beneath the bottom plate 162 for providing further means for attaching the clip apparatus 160 to a strap, fabric or other article of clothing. In addition, other features, such as additional clips, magnets, or other like attaching means may be used to hold the bottom plate 162 and the top plate 164 in mating position.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A system comprising:

a clip apparatus comprising:

a bottom plate;

a top plate comprising an aperture;

a bridge between the bottom plate and the top plate holding the bottom plate a distance from the top plate;

a resilient frame disposed within the bottom plate, the top plate and the bridge;

a mounded protrusion extending upwardly from the bottom plate toward the top plate, wherein the mounded protrusion extends through the aperture in the top plate such that a top surface of the mounded protrusion extends above a top surface of the top plate and further wherein the top plate and the aperture within the top plate completely surround the mounded protrusion; and a clothing article disposed over the protrusion and frictionally held in place over the protrusion, and further wherein the clothing article is pushed through the aperture of the top plate by the mounded protrusion.

2. The system of claim 1 wherein the bridge is disposed on a side of the clip apparatus.

3. The system of claim 1 wherein the resilient frame is made of metal.

4. The system of claim 1 wherein the top plate, the bottom plate and the bridge are made from a same material.

5. The system of claim 4 wherein the protrusion is made from the same material as the top plate, the bottom plate and the bridge.

6. The system of claim 4 wherein the protrusion is made from a different material as the top plate, the bottom plate and the bridge.

7. The system of claim 1 wherein the clothing article is frictionally held between the protrusion and an edge of the aperture of the top plate.

8. The system of claim 1 wherein the clothing article is frictionally held between the protrusion and a bottom surface of the top plate.

9. A method of using a clip apparatus comprising the steps of:

providing a clip apparatus comprising a bottom plate, a top plate comprising an aperture, a bridge between the bottom plate and the top plate holding the bottom plate a distance from the top plate, a resilient frame within the bottom plate, the top plate and the bridge, and a mounded protrusion extending upwardly from the bottom plate toward the top plate, wherein the mounded protrusion extends through the aperture in the top plate such that a top surface of the mounded protrusion extends above a top surface of the top plate and further wherein the top plate and the aperture within the top plate completely surround the mounded protrusion;

providing an article of clothing having a first location; and disposing the first location of the article of clothing over the protrusion wherein the article of clothing is pushed through the aperture of the top plate by the mounded protrusion.

10. The method of claim 9 wherein a strap of the article is resiliently held over the protrusion.

11. The method of claim 9 wherein the article of clothing is resiliently held between the protrusion and the top plate.

12. The method of claim 9 further comprising the steps of:

moving the clip apparatus to a second location on the article of clothing; and disposing the article of clothing within the clip apparatus at the second location of the article of clothing.

13. The method of claim 12 wherein the clip apparatus is disposed at the first location at a first time, and the clip apparatus is disposed at the second location at a second time, wherein the second time is intended for after breastfeeding a baby.

14. The method of claim 12 wherein the first location is a first bra strap intended to be on a first side of a person, and the second location is a second bra strap intended to be on a second side of a person.

15. A clip apparatus comprising:

a bottom plate;

a top plate comprising an aperture;

a bridge between the bottom plate and the top plate holding the bottom plate a distance from the top plate; and a mounded protrusion extending upwardly from the bottom plate toward the top plate, wherein the mounded protrusion extends through the aperture in the top plate such that a top surface of the mounded protrusion extends above a top surface of the top plate and further wherein the top plate and the aperture within the top plate completely surround the mounded protrusion, wherein a resilient frame is disposed within the bottom plate, the top plate and the bridge.

16. The clip apparatus of claim 15 wherein the resilient frame is made of metal.

17. The clip apparatus of claim 15 wherein the top plate, the bottom plate and the bridge are made from a same material.

18. The clip apparatus of claim 17 wherein the protrusion is made from the same material as the top plate, the bottom plate and the bridge.

19. The clip apparatus of claim 17 wherein the protrusion is made from a different material as the top plate, the bottom plate and the bridge.

* * * * *